US005558441A

United States Patent [19]

Morrison et al.

[11] Patent Number: 5,558,441

[45] Date of Patent: Sep. 24, 1996

[54] RECEPTACLE

[76] Inventors: Kenneth V. Morrison; Rick L. Felton, both of 40 N. Kingshighway, St. Louis, Mo. 63108; Vernon S. Eckert, 8024 Pembroke Dr., St. Louis, Mo. 63123

[21] Appl. No.: 353,823

[22] Filed: Dec. 12, 1994

[51] Int. Cl.[6] ..... B65D 33/01

[52] U.S. Cl. ..... 383/100; 383/44

[58] Field of Search ..... 383/44, 45, 48, 383/100, 101, 102, 103

[56] References Cited

U.S. PATENT DOCUMENTS

| | | | |
|---|---|---|---|
| 3,302,859 | 2/1967 | Perry . | |
| 3,309,006 | 3/1967 | Perry et al. . | |
| 3,371,849 | 3/1968 | Rochla | 383/44 |
| 3,394,871 | 7/1968 | Williams et al. . | |
| 3,430,842 | 3/1969 | Yamaguchi | 383/44 X |
| 3,595,467 | 7/1971 | Goglio . | |
| 3,672,915 | 6/1972 | Wiggins . | |
| 3,715,855 | 2/1973 | Armstrong . | |
| 3,937,396 | 2/1976 | Schneider . | |
| 4,166,842 | 9/1979 | Sanders | 383/44 X |
| 4,284,228 | 8/1981 | Cetrelli . | |
| 4,470,153 | 9/1984 | Kenan . | |
| 4,581,764 | 4/1986 | Plock et al. . | |
| 4,672,684 | 6/1987 | Barnes et al. . | |
| 4,674,532 | 6/1987 | Koyanagi . | |
| 4,708,167 | 11/1987 | Koyanagi . | |
| 4,712,249 | 12/1987 | Gannon . | |
| 4,842,007 | 6/1989 | Kurtz . | |
| 4,890,637 | 1/1990 | Lamparter . | |
| 4,917,646 | 4/1990 | Kieves . | |
| 4,949,756 | 8/1990 | Melinyshyn et al. . | |
| 5,144,708 | 9/1992 | Pekar . | |
| 5,209,264 | 5/1993 | Koyanagi . | |
| 5,295,892 | 3/1994 | Felton . | |

FOREIGN PATENT DOCUMENTS

| | | | |
|---|---|---|---|
| 1277619 | 10/1961 | France | 383/44 |
| 1086622 | 8/1960 | Germany | 383/44 |
| 2747071 | 4/1979 | Germany | 383/103 |
| 1002149 | 8/1965 | United Kingdom | 383/44 |

*Primary Examiner*—Jes F. Pascua
*Attorney, Agent, or Firm*—Howell & Haferkamp, L.C.

[57] ABSTRACT

A receptacle made of air-impervious sheet material which is heat-sealable at least on one face thereof. The receptacle has portions with the heat-sealable face of one portion opposed to the heat-sealable face of another. The portions are heat-sealed together forming a seal for the receptacle. The receptacle has a check valve for venting air therefrom for deflation of the receptacle while checking ingress of outside air. The check valve comprises an elongate flat tube of heat-sealable sheet material extending between the portions of the receptacle through the seal from the inside to the outside of the receptacle. The tube has opposed walls with an elongate longitudinal passage between them from one end of the tube to the other. The opposed portions of the receptacle are heat-sealed to the outside of the tube in line with the seal. The tube has material therein for inhibiting sealing together of its walls for allowing simultaneous formation of the seal and heat sealing of the portions of the receptacle to the outside of the tube.

13 Claims, 2 Drawing Sheets

RECEPTACLE

BACKGROUND OF THE INVENTION

This invention relates generally to receptacles, and more particularly to receptacles for containing dry granular product, such as animal feed.

Paper bags and plastic bags are often used as receptacles for containing dry and semi-moist animal feed, such as dog food. Plastic bags offer several advantages. For example, the use of plastic provides an effective barrier against leakage of product from the bag and the passage of moisture into the bag. Plastic bags are also generally readily closeable, as by heat sealing, after the bag is filled with product. However, when the bags are filled with product and then sealed closed, air is trapped in the bags. The fullness of the bags caused by the air makes it difficult to stack the bags and also increases the inventory space required to store the filled bags. It is undesirable to put holes in the bags to vent the air because such holes may allow passage of moisture into the bags which may damage the product. The presence of such holes also increases the risk of infestation of the bag by insects and mites.

There is a need, therefore, for a receptacle which eliminates the problems associated with conventional receptacles.

SUMMARY OF THE INVENTION

Among the several objects of this invention may be noted the provision of an improved receptacle for containing dry and semi-moist granular product; the provision of such a receptacle which enables air to be vented therefrom for stable stacking and for minimizing inventory space requirements; the provision of such a receptacle which prevents passage of moisture into the receptacle; the provision of such a receptacle which prevents passage of mites and insects into the receptacle; and the provision of such a receptacle which is of relatively simple and inexpensive construction.

Generally, a receptacle of the present invention is made of air-impervious sheet material which is heat-sealable at least on one face thereof. The receptacle has portions with the heat-sealable face of one portion opposed to the heat-sealable face of another. The portions are heat-sealed together forming a seal for the receptacle. The receptacle has a check valve for venting air therefrom for deflation of the receptacle while checking ingress of outside air. The check valve comprises an elongate flat tube of heat-sealable sheet material extending between the portions of the receptacle through the seal from the inside to the outside of the receptacle. The tube has opposed walls with an elongate longitudinal passage between them from one end of the tube to the other. The opposed portions of the receptacle are heat-sealed to the outside of the tube in line with the seal. The tube has means therein for inhibiting sealing together of its walls allowing simultaneous formation of the heat seal and heat sealing of the portions of the receptacle to the outside of the tube.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
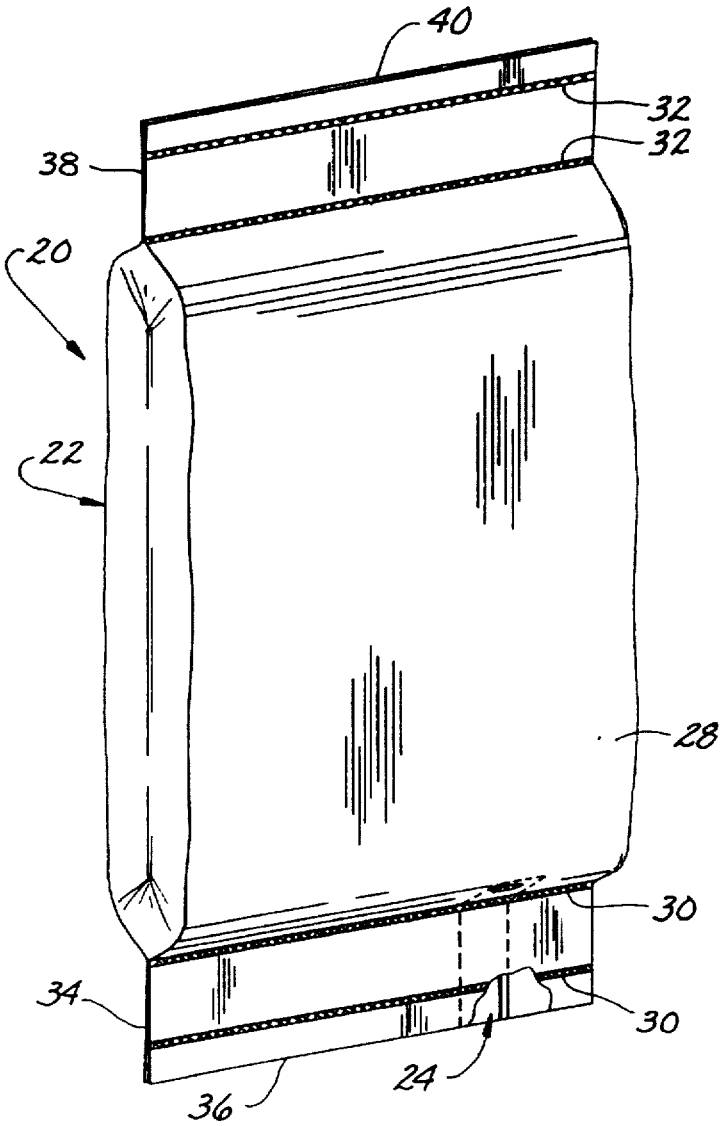
FIG. 1 view of a receptacle of this invention.

Referring now to the drawings, and first more particularly to FIG. 1, a receptacle of the present invention is indicated generally at 20. The receptacle 20 comprises a bag, generally indicated at 22, and a check valve, generally indicated at 24. The bag 22 is made of air-impervious, moisture-impervious, flexible sheet material, such as polyethylene or other suitable polymeric resin. The bag 22 is preferably a seamless tube. Alternatively, the bag 22 may be of a single sheet with the longitudinal edges joined together, or may be of two superimposed sheets joined together along their longitudinal edges. The bag 22 has first and second opposed walls 26, 28 each having an inner face. At least the inner faces of the bag walls 26, 28 are heat-sealable. These inner faces are heat-sealed together to form first and second pairs of seals 30, 32 for the receptacle 20. The first pair of seals 30 (lower pair of seals as viewed in FIG. 1) extends laterally across first (lower) portions 34 of the walls 26, 28 and closes a first (lower) end 36 of the bag 22. The second (upper) pair of seals 32 extends laterally across second (upper) portions 38 of the walls 26, 28 and closes a second (upper) end 40 of the bag 22. Preferably, only one of the pairs (e.g., the lower pair 30) is formed prior to filling of the bag 22 with product (not shown) so that the bag is closed at one end and open at the other. After the bag 22 is filled with product, the other pair of seals (e.g., the upper pair 32) is formed to contain the product in the bag.

Figure 5:
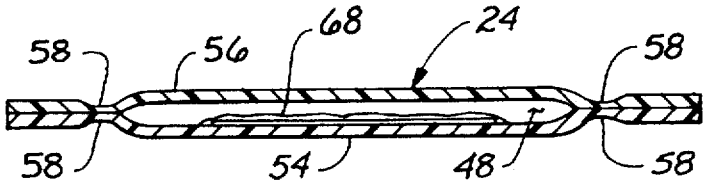
FIG. 5 is a cross-sectional view taken along the plane of line 5—5 of FIG. 4.

The check valve 24 vents air from inside the bag 22 to deflate the bag while checking ingress of outside air. It comprises an elongate flat tube 42 of heat-sealable sheet material having opposed walls 44, 46 with an elongate longitudinal passage 48 (FIGS. 3 and 5) between them from a first (inlet) end 50 of the valve tube 42 to a second (discharge) end 52. Preferably, the tube 42 comprises first and second strips 54, 56 of flexible heat-sealable sheet plastic material superimposed one on the other and heat sealed together along longitudinal side margins 58 thereof. Alternatively, the valve tube may comprise a seamless tube or a single folded sheet which is heat sealed at an elongate edge margin.

Figure 3:
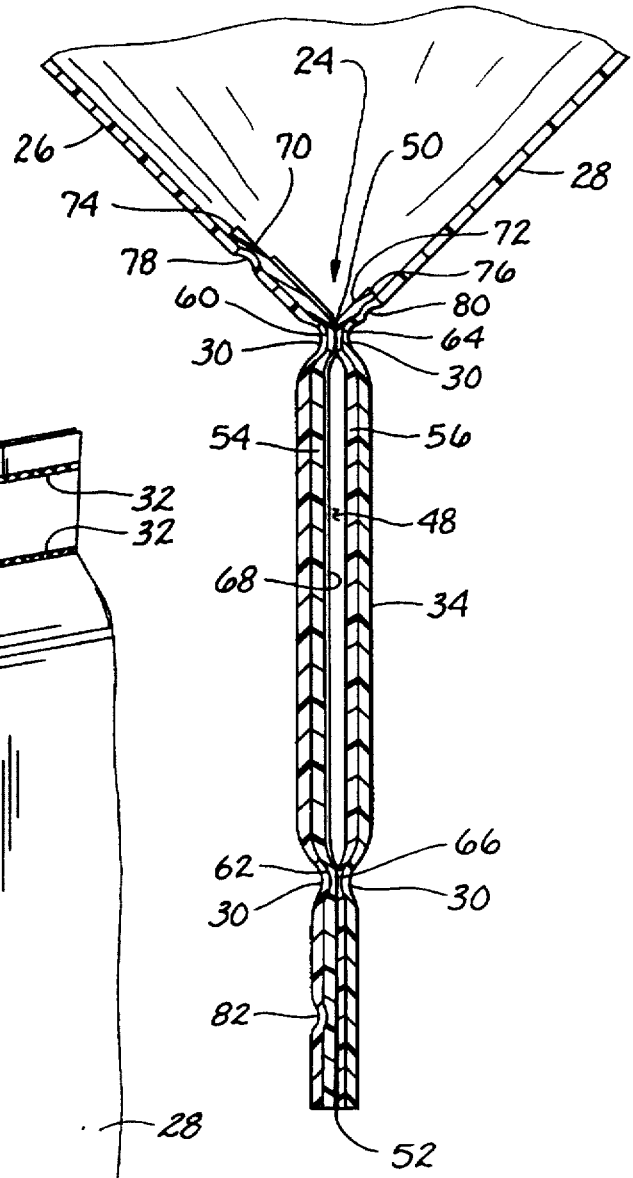
FIG. 3 is a cross-sectional view taken along the plane of line 3—3 of FIG. 2 showing the check valve within the bag.

The check valve 24 is positioned between the lower portions 34 of the first and second walls 26, 28 and extends through the lower pair of seals 30 lengthwise of the bag 22 from the inside to the outside of the bag. Referring to FIG. 3, the first wall 26 of the bag 22 is heat sealed at 60 and 62 to the outside of the first strip 54 of the valve 24 in line with respective seals of the lower pair of seals 30. The second wall 28 of the bag 22 is heat sealed at 64 and 66 to the outside of the second strip 56 in line with respective seals of the lower pair of seals 30. A coating 68 of heat-seal-inhibiting material is on the inside face of the first strip 54 of the valve 24. This coating 68 comprises means for inhibiting sealing together of the walls 44, 46 of the valve tube 42 and allows simultaneous formation of the first pair of seals 30 and heat sealing of the walls 26, 28 of the bag 22 to the outside of the tube. Preferably, the coating 68 comprises a stripe of heat-seal inhibiting ink printed on the inside face of the first strip 54 of the valve 24.

Figure 2:
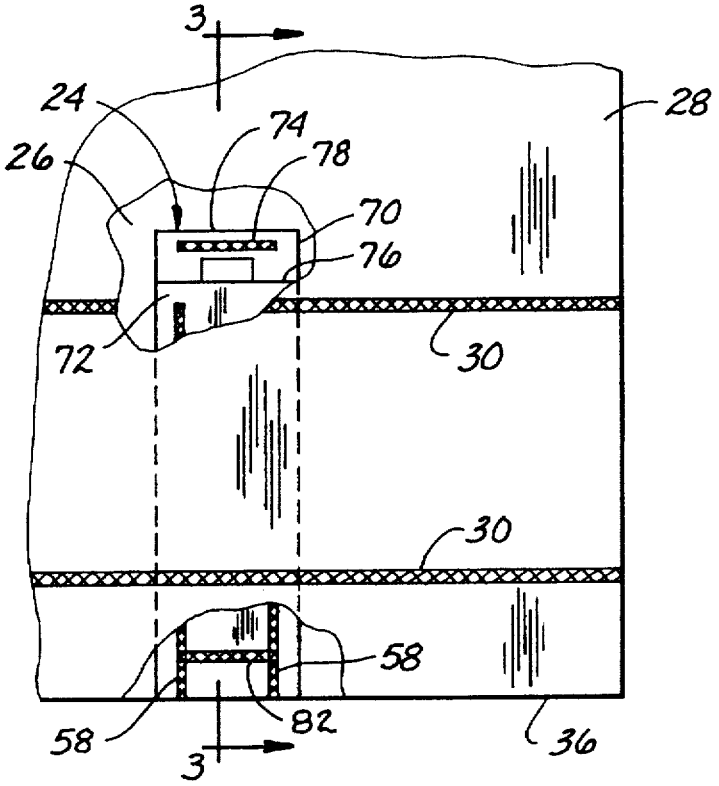
FIG. 2 is a fragmented plan view of the receptacle of FIG. 1 showing a bag of the receptacle with portions broken away to show a check valve of the receptacle.
Figure 4:
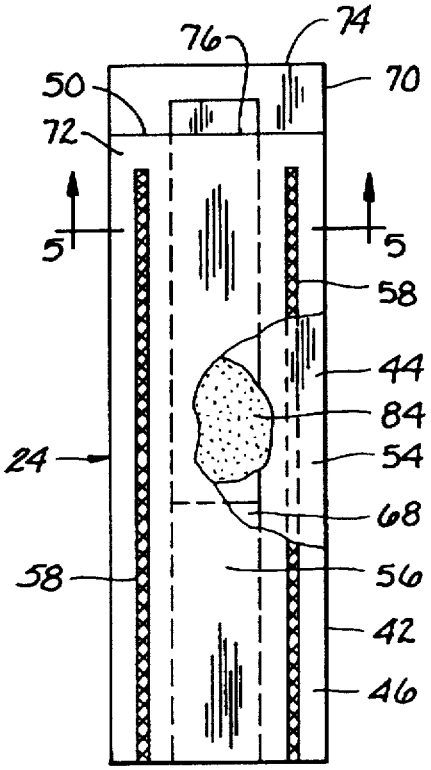
FIG. 4 is a plan view of the check valve of FIG. 2 with portions; broken away to show detail.
Figure 6:
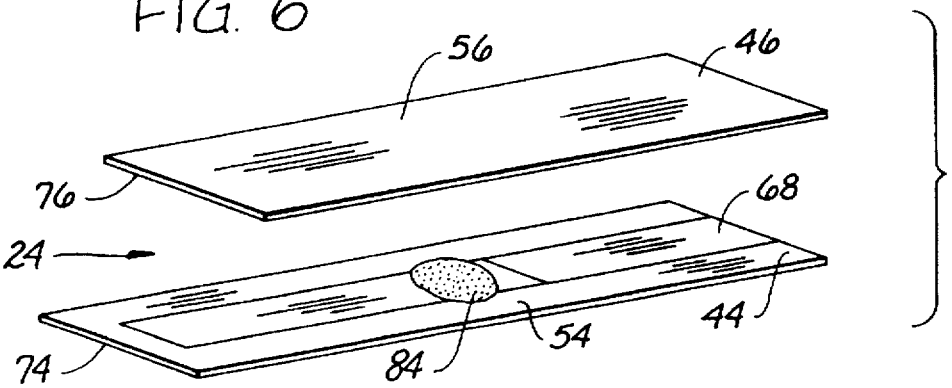
FIG. 6 is an exploded perspective view of the check valve of FIG. 4.

Referring to FIGS. 3, 4 and 6, the first and second strips 54, 56 have upper flaps 70, 72, respectively, adjacent their first (upper) ends 74, 76. Preferably, the upper ends 74, 76 of the strips 54, 56 are offset so that the upper flap 70 of the first strip is longer than the upper flap 72 of the second strip. The upper flap 70 of the first strip 54 is heat sealed at 78 (FIGS. 2 and 3) to the first wall 26 of the bag 22 and the upper flap 72 of the second strip 56 is heat sealed at 80 (FIG. 3) to the second wall 28 to maintain the inlet end 50 of the elongate passage 48 in an open position (i.e., the inlet end 50 of the elongate passage is continuously substained in an open position at all times during normal use of the bag regardless of whether air is being vented from the bag) Preferably, a lower portion of the first strip 54 is heat sealed at 82 (FIGS. 2 and 3) to the first wall 26 to maintain the position of the check valve 24 relative to the bag 22.

Preferably, at least a portion of the inside of the valve tube 42 is coated with a non-volatile, non-toxic fluid 84 (FIGS. 4 and 6), such as vegetable oil, to prevent mites from entering the receptacle 20 through the tube.

In operation, the upper end 40 of the bag 22 is open and unsealed (not shown) prior to being filled with product and the lower end 36 is sealed. Product is poured into the bag 22 and the upper end 40 is then closed by forming the upper pair of seals 32. The bag 22 is then compressed (e.g., by passing a roller over the filled bag) to expel air from inside the bag out the check valve 24. Because the flaps 70, 72 of the valve 24 are secured to the walls 26, 28 of the bag 22, the inlet end 50 of the elongate passage 48 is maintained open. If the air pressure within the bag 22 is greater than ambient air pressure, then the air in the bag will force the valve strips 54, 56 to separate to open the passage 48 and thereby permit discharge of the air through the check valve 24. When air is not being vented from the bag 22, the non-volatile fluid 84 keeps the passage closed to prevent mites or small insects from entering the receptacle 20 through the valve tube 42. Preferably, the fluid 82 is sufficiently non-viscous so as not to interfere with separation of the strips 54, 56 during venting of air from the bag 22.

In view of the above, it will be seen that the several objects of the invention are achieved and other advantageous results attained.

As various changes could be made in the above construction without departing from the scope of the invention, it is intended that all matter contained in the above description or shown in the accompanying drawings shall be interpreted as illustrative and not in a limiting sense.

What is claimed is:

1. A receptacle made of air-impervious sheet material which is heat-sealable at least on one face thereof, said receptacle having portions with the heat-sealable face of one portion opposed to the heat-sealable face of another, said portions being heat-sealed together forming a seal for the receptacle, said receptacle having a check valve for venting air therefrom for deflation of the receptacle while checking ingress of outside air, said check valve comprising an elongate flat tube of heat-sealable sheet material extending between said portions of the receptacle through the seal from the inside to the outside of the receptacle, said tube having opposed walls, an inlet end, a discharge end, an elongate longitudinal passage between the opposed walls and extending from the inlet end of the tube to the discharge end, said opposed portions of the receptacle being heat-sealed to the outside of the tube in line with said seal, and said tube having means therein for inhibiting sealing together of its walls allowing simultaneous formation of said seal and heat sealing of said portions of the receptacle to the outside of the tube, the inlet end of the tube being inside the receptacle and the outlet end of the tube being outside the receptacle, said opposed portions of the receptacle being bonded to the walls of the tube at the inlet end of the tube for maintaining the inlet end of the tube in an open position.

2. A receptacle as set forth in claim 1 wherein said seal-inhibiting means comprises a coating of heat-seal-inhibiting material on the inside face of one wall of the tube.

3. A receptacle as set forth in claim 2 wherein the tube comprises two strips of flexible heat-sealable sheet plastic material superimposed one on the other and sealed together along the longitudinal margins thereof, the coating comprising a stripe of heat-seal inhibiting ink printed on that face of one of the strips which is its inside face in respect to the tube.

4. A receptacle as set forth in claim 3 wherein the tube has another coating therein of a non-volatile fluid for maintaining the elongate passage of the tube closed to prevent mites from entering the receptacle through the tube when air is not being vented from the receptacle without interfering with separation of the strips for venting air.

5. A receptacle as set forth in claim 1 comprising a bag made of flexible sheet material which is heat-sealable at least on the inside, the bag having opposed walls and said opposed portions comprising portions of the walls of the bag adjacent one end thereof, said seal extending across the bag adjacent said one end thereof and constituting an end seal for the bag, the tube extending lengthwise of the bag from the inside to the outside of said seal.

6. A bag as set forth in claim 5 wherein said seal-inhibiting means comprises a coating of heat-seal-inhibiting material on the inside face of one wall of the tube.

7. A bag as set forth in claim 6 wherein the tube comprises two strips of flexible heat-sealable sheet plastic material superimposed one on the other and sealed together along the longitudinal margins thereof, the coating comprising a stripe of heat-seal inhibiting ink printed on the face of one of the strips which is its inside face in respect to the tube.

8. A bag as set forth in claim 5 wherein the tube has a coating therein of a non-volatile fluid for maintaining the elongate passage of the tube closed to prevent mites from entering the bag through the tube when air is not being vented from the receptacle without interfering with separation of the strips for venting air.

9. A receptacle as set forth in claim 1 wherein the tube comprises two strips of flexible heat-sealable sheet plastic material superimposed one on the other and sealed together along the longitudinal margins thereof.

10. A receptacle as set forth in claim 1 wherein the tube has a coating therein of a non-volatile fluid for maintaining the elongate passage of the tube closed to prevent mites from entering the receptacle through the tube when air is not being vented from the receptacle without interfering with separation of the strips for venting air.

11. A receptacle as set forth in claim 10 wherein the non-volatile fluid maintains the elongate passage of the tube closed when air is not being vented from the receptacle.

12. A receptacle as set forth in claim 1 wherein the check valve is configured for venting air from the receptacle through the entire length of the elongate longitudinal passage.

13. A receptacle as set forth in claim 1 wherein a non-volatile fluid is within the tube for maintaining the elongate passage of the tube closed when air is not being vented from the receptacle without interfering with separation of the opposed walls of the tube for venting air.

* * * * *